US010676849B2

(12) United States Patent
Weiner

(10) Patent No.: US 10,676,849 B2
(45) **Date of Patent: *Jun. 9, 2020**

(54) MULTIPLE TWISTED YARNS DIRECTED THROUGH A SINGLE NEEDLE OF A TUFTING MACHINE

(71) Applicant: ENGINEERED FLOORS, LLC, Dalton, GA (US)

(72) Inventor: Robert S. Weiner, Atlanta, GA (US)

(73) Assignee: ENGINEERED FLOORS, LLC, Dalton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/156,346

(22) Filed: Oct. 10, 2018

(65) Prior Publication Data

US 2019/0040560 A1 Feb. 7, 2019

Related U.S. Application Data

(60) Division of application No. 15/138,589, filed on Apr. 26, 2016, now Pat. No. 10,125,441, which is a continuation-in-part of application No. 14/160,123, filed on Jan. 21, 2014, now Pat. No. 9,416,466.

(60) Provisional application No. 61/791,241, filed on Mar. 15, 2013, provisional application No. 62/168,001, filed on May 29, 2015.

(51) Int. Cl.

| | |
|---|---|
| ***D05C 15/16*** | (2006.01) |
| ***D05C 15/08*** | (2006.01) |
| ***D02G 3/28*** | (2006.01) |
| ***D05C 15/18*** | (2006.01) |

(52) U.S. Cl.
CPC ..... *D05C 15/08* (2013.01); *D02G 3/283* (2013.01); *D05C 15/16* (2013.01); *D05C 15/18* (2013.01)

(58) Field of Classification Search
CPC ..... D05C 15/16; D05C 15/32; D05C 15/20; D05C 17/026
See application file for complete search history.

(56) References Cited

U.S. PATENT DOCUMENTS

| | | | |
|---|---|---|---|
| 2,961,010 | A | 11/1960 | Berry |
| 3,146,573 | A | 9/1964 | Jones et al. |
| 3,237,391 | A | 3/1966 | Carruthers |
| 3,935,698 | A | 2/1976 | Lesnik |
| 4,114,549 | A | 9/1978 | Chambley et al. |
| 4,389,837 | A | 6/1983 | Stahlecker et al. |
| 4,998,403 | A | 3/1991 | Bailey |
| 5,413,832 | A | 5/1995 | Willey |
| 5,531,392 | A | 7/1996 | Weiner |
| 5,613,643 | A | 3/1997 | Weiner |
| 5,901,544 | A | 5/1999 | McNeill |
| 6,101,801 | A | 8/2000 | Boni |
| 6,446,566 | B1 | 9/2002 | Bennett et al. |
| 6,592,069 | B1 | 7/2003 | Cobble |
| 6,718,748 | B1 | 4/2004 | Patterson |
| 6,895,877 | B1 | 5/2005 | Weiner |

(Continued)

*Primary Examiner* — Tajash D Patel
(74) *Attorney, Agent, or Firm* — Gardner Groff & Greenwald, PC

(57) ABSTRACT

A method of tufting carpet using multiple yarns directed through at least one single needle, if not a plurality of such situations, whereby the needles tuft a carpet having unique specifications. Specifically, the yarns are pre-twisted together, and can be solution dyed and/or of have different twist characteristics, such as selected from the group of high twist, standard twist, low twist, no twist, flat yarns and/or pre-twisted flat yarns.

20 Claims, 1 Drawing Sheet

(56) References Cited

U.S. PATENT DOCUMENTS

| | | | |
|---|---|---|---|
| 8,347,800 | B1 | 1/2013 | Machell-Archer et al. |
| 9,416,466 | B1 | 8/2016 | Weiner |
| 10,125,441 | B1 | 11/2018 | Weiner |

MULTIPLE TWISTED YARNS DIRECTED THROUGH A SINGLE NEEDLE OF A TUFTING MACHINE

CLAIM OF PROOF

The applicant claims priority to and/or the benefit of U.S. application Ser. No. 15/138,589 filed Apr. 26, 2016, which claims the benefit of U.S. application Ser. No. 14/160,123 filed Jan. 21, 2014, which claims the benefit of U.S. Provisional App. No. 61/791,241 filed Mar. 15, 2013, as well as U.S. Provisional App. No. 62/168,001 filed May 29, 2015, all of which are incorporated herein by reference in their entirety.

BACKGROUND OF THE INVENTION

Multiple yarns have been directed through a single needle using various techniques. For instance, U.S. Pat. Nos. 5,531,392 and 5,613,643 show directing multiple yarn strands to a single yarn guide tube. However, these are not solution dyed yarns, and to the extent these yarns become twisted, they are left to, at best randomization with that process and certainly not at a twist of greater than one twist per thirty inches, if at all, and definitely not a pre-determined twist.

Additionally, cone holders are normally provided with a single yarn wrapped therearound. Warpers have been utilized by having multiple yarns directed therearound such as shown in U.S. Pat. No. 6,592,069 but once again these yarns are not typically twisted together in a predetermined manner.

Selective tensioning of yarn with U.S. Pat. No. 6,895,877 whereby multiple yarns are directed through a single needle, but once again, they are not provided with a predetermined twist.

SUMMARY OF THE INVENTION

It is an object in many embodiments of the present invention to provide distinct yarns having at least a certain amount of pre-determined twist therebetween the distinct yarns as fed through a single needle of a tufting machine, while retaining distinctiveness of the yarns after being tufted.

It is another object of many embodiments of the present invention to provide multiple distinct and different yarns twisted together with a pre-determined twist and directed through a single eye of a needle in a tufting machine.

It is an object of many embodiments of the present invention to provide multiple yarns through a single needle of a tufting machine in order to provide a desired aesthetic effect in a tufted carpet design.

Accordingly, in accordance with a first presently preferred embodiment of the present invention, a method of tufting carpet is provided in which a plurality of separate yarns are twisted together in a predetermined fashion having at least a pre-determined minimum twist per inch of at least one twist per twenty inches, or every six inches, if not having at least a predetermined twist such as at least two twists per inch, but not exceeding six twists per inch, with at least two yarns if not three, four or more yarns all directed through the eye of a single needle when constructing carpet through tufting.

Variability of the twist rate of the individual yarns can be provided for at least some embodiments as long as the twist rate ranges between about one twist per twenty inches to no more than about six twists per inch, and more preferably a twist rate of between about one twist per six inches, or one twist per every two inches and no more than about six twists per inch. Some embodiments of the applicant include a twist per inch of about 1 twist per every two inches, and some at about 1 twist per inch.

The applicant is not intending to form a single yarn as one of a thicker diameter than the corresponding yarns, but instead, the applicant is intending to twist separate yarns together, preferably in a relative loose manner for many embodiments so that as they are tufted as shown in FIG. 2, each of the separate yarns forms distinct loops (whether subsequently cut or not) in that process which are thereby distinguishable from other loops or other cut loops, but tufted with a single needle. Some embodiments provide cut loops which add additional aesthetic characteristics.

When selecting the desired amount of twist, the twist will not likely exceed about six twists per inch and more likely will not exceed three or two twists per inch for many embodiments. Most embodiments will likely exceed at least one twist for every about two inches, although some other embodiments may have as few as one twist for every six inches for at least some embodiments.

Twists can be imparted by cabling, twisting, and/or other techniques to either provide at least a certain amount of twist and thereby provided a desired amount of twist.

Of the yarns twisted together, at least one will preferably have at least one different characteristic such as at least a different twist ratio of the yarn, different color combinations such as A being a different color than B, which may or may not be a different color than yarn C, etc. A yarn could also be a different material and/or diameter, etc. Accordingly, a very different looking end product can be provided than has traditionally been provided. Although random twisting of non-solution dyed yarns has possibly been provided with the prior art technique of U.S. Pat. Nos. 5,531,392 and 5,613,643, and even selective tensioning of yarn with U.S. Pat. No. 6,895,877, these technologies do not impart a predetermined twist to multiple yarns directed through an eye of a needle and certainly not more than one twist per thirty inches. None of the known prior art provides a known twist to individual separate yarns as they are directed through a single eye of a tufting machine with an intent they at least partially separate after passing through the backing to be distinguishable as their separate yarns.

Furthermore, tight twisted individual yarns could be one of the yarns, such as having an individual twist rate of about 7 twists per inch (it being understood that individual twist rate relates to the individual component yarn A,B, or C), which is typically solution dyed, heat set yarns. Standard twisted yarns could be one of the other of component yarns A,B, and/or C which typically have an individual twist rate of about 4½ to about 5½ twists per inch. These yarns do not separate into strands after tufting (even when cut) which is what distinguishes component or individual yarns from multiple yarns directed through a single needle. Lower or low twist rate yarn can be used (many of which being heat set at a desired twist of less than 4½ twists per inch). In fact, no twist, or flat yarn can be used for some embodiments as one of A, B and/or C. The applicant has even twisted flat yarn such as up to about 3 twists per inch, but no more than about 6 twists per inch to use as one of the component yarns A, B and/or C. At least about ½ if not 1 twist per inch has been found to provide effects of twisting individual flat yarns when combining with other yarns as described herein through a single needle to a desired predetermined twist.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
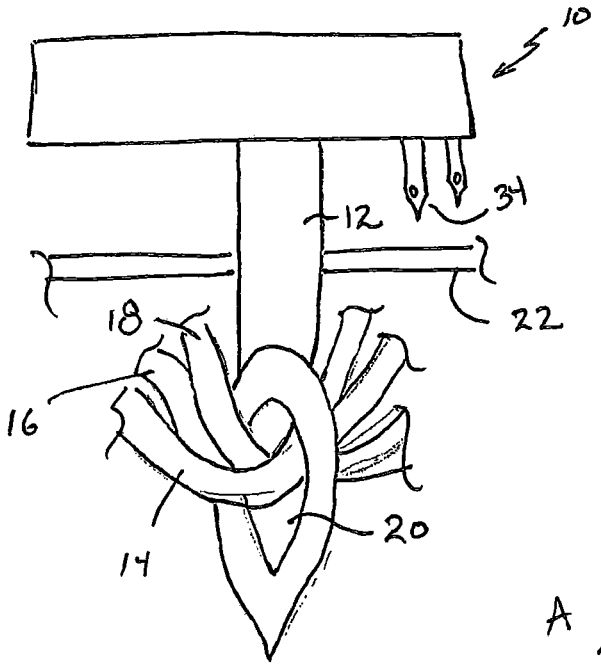
FIG. 1 is a present preferred embodiment of the present invention showing a twisted set of yarns being directed through a single needle of a tufting machine.

FIG. 1 shows a tufting machine 10 having first and second needles 12,34, the first needle 12 having three distinct yarns 14,16,18 being directed through an eye 20 of a needle 12. Second needle 34 and others may have similar or dissimilar numbers of distinct yarn directed therethrough. By being distinct, the yarns are preferably not connected together other than being bound together at and/or in the backing. (i.e., could one be pulled, the other(s) would remain where they were tufted unless the friction at the penetration of the single needle pulled the adjacent yarn(s)). These three yarns are representative in number (more or fewer could be provided with other embodiments) and other positions have one and even four yarns preferably then combined twisted together with a twist per inch less than enough to maintain the yarns as a single yarn once tufted as is shown in FIG. 2, so each of the yarns spread apart at least enough to distinguish the separate yarns 14,16,18 at least after if not during tufting whether it is tufted to provide a tufted loop or a cut loop as would be understood by those of ordinary skill in the art.

Figure 2:
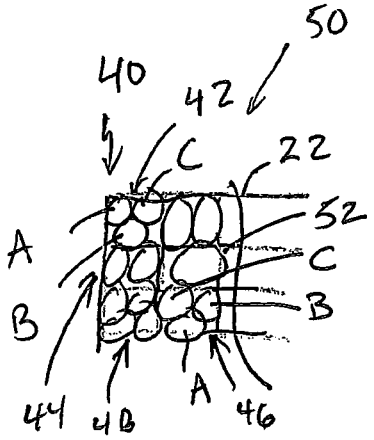
FIG. 2 shows a presently preferred embodiment of the present invention providing a top view of tufted carpet produced by the machine of FIG. 1.
Figure 3:
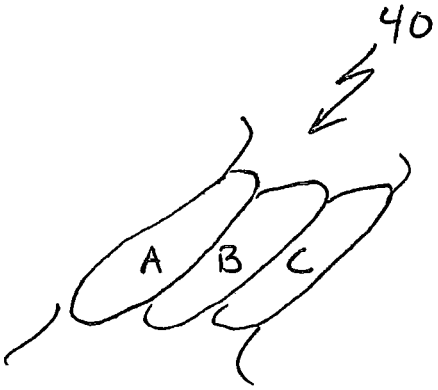
FIG. 3 shows the yarn before passing through the backing.

FIG. 2 shows an embodiment with a carpet design 50 with the combined yarns 40 being directed through a first position 42. A second position 44 shows two yarns such as there are only being two yarns directed through a needle 34, etc., as tufted through backing 22 in FIG. 1.

To date, when tufting multiple yarns through an eye of a single needle such as the creel designs of the applicant's prior designs with non-solution dyed yarns (U.S. Pat. Nos. 5,531,352, 5,613,613 and 6,895,877), the extent of the twist was not measured and was certainly less than one twist per thirty inches and, if any twisting was performed at all, was done in a random manner and likely in both directions of twist. Additionally, these designs were done with component yarns of the same twist rate and diameter, just different dye absorbing characteristics.

With the applicant's current technology, a purposeful twist of at least one twist per every twenty four inches, if not every six inches, is provided, between individual yarns which are intended to separate from one another to be distinguishable as separate yarns after tufting. Many embodiments twist in a single direction amongst the component yarns. Furthermore, the amount of twist per inch is not so great, such as over six twists per inch, so as to cause the component yarns to be viewed after tufting as a single yarn. In fact, after tufting such as shown in FIG. 2, the yarns can be readily identifiable as individual yarns tufted just through a common perforation by a single needle 12,34. Due to a preferable pre-determined twist, the adjacent nature of tufts provided through the tuft causes the relative placements of each of the specific yarn ends to move relative to one another, i.e., for location 46, the tufts of yarns A,B,C is not the same radial as location 42, yarns A, B and C will be located in different positions due to rotation in part aided by the twist. Specifically, they have a different angular relationship. For some embodiments, the amount of pre-determined twist could vary along the length of the combined yarns A, B and/or C as they proceed through the needle such as within a range of greater than about one twist per every twenty inches to about six twists per inch, but for many embodiments, such variation may not be desirable, or generate any additional effects than a pre-selected pre-determined twist.

Twisting to provide the combined twist can be achieved with cabling equipment, twisting equipment and/or other equipment as is known in the art so as to provide a known twist for at least some embodiments to the respective yarns, without maintaining the twist after tufting to form a single appearing yarn end.

Furthermore, FIG. 1 and others show that combined yarns A,B,C could be utilized through a single needle 12. Some locations such as location 44 has two yarns, location 48 could have four yarns or more, location 52 has a single yarn, etc. All these could all depend on how the tufting machine is set up and fed with particular yarns to specific needles and which needles tuft any given position through the backing 22 which would be understood by those of ordinary skill in the art.

It is anticipated that at least one of the component yarns A,B,C (and/or others) as fed to the eye 20 of the needle 12 would be different from the other yarns directed through eye 20 such as by having at least one noticeable characteristic difference whether it be a noticeable color difference, a noticeable individual yarn twist difference, a material difference, a diameter difference and/or other feature difference which could be readily distinguished after the carpet is tufted, if not before. The yarns A,B,C may preferably be solution dyed, and for twisted yarn, such as standard (normally 4.5-5.5 twists per inch) or high twist yarns (above 6 twists per inch, such as about 7 twists per inch), are preferably heat set so that they do not un-ravel after tufting, particularly in the case of cut loop carpet constructions.

Flat yarns could be utilized as any of component yarns A, B and/or C. Flat yarns have no-twist, and for some embodiments, the applicant has twisted flat yarns with at least about ½ twist to 4 twists per inch before combining with other yarns (to be combined twisted), such as either individual standard or high twist yarns to create somewhat unique effects for at least some embodiments. This twisting of flat component yarns is typically not heat set, so these flat yarns tend to "unravel" after being tufted, when cut. Other embodiments use the flat yarns without twist.

A pre-determined combined twist is preferably pre-determined before at least the yarns A,B,C are provided to the eye 20 of the needle 12 as a combined. The rate of twist could change for at least some embodiments.

In some embodiments, the loops or cut pile may be produced by the methodology described herein. The yarns may remain partially interconnected, but are preferably still visually distinct from one another which separates this technology from just portions of single, individual yarns which are not visually different from the remained of the yarn they comprise as they have the same characteristics and are intended to be a single yarn strand. The applicant's technology is quite different in that the distinct yarns are intentionally twisted together for the tufting process with the knowledge that once the strands are tufted through the backing 22, they will separate to at least a degree for at least one of the yarn strands to be distinct or to be recognizably distinct from one another.

Yarns of differing diameters for at least one of component yarns A,B and/or C may be employed using the technology described herein. Although not all embodiments have to have a predetermined twist, such a feature has been employed with many embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A method of manufacturing carpet comprising the steps of: a) directing at least first and second distinct yarns to a single needle of a tufting machine, said second yarn being one of a flat yarn and a standard twist yarn with an internal twist of about 4½ to about 5½ twists per inch; b) tufting carpet using the single needle; wherein the first and second distinct yarns are twisted together at a predetermined twist rate between about 0.05 twists per inch and about six twists per inch, prior to being tufted into the carpet.

2. The method of claim 1 wherein the first yarn is a high twist yarn as defined as a heat set yarn having above six twists per inch.

3. The method of claim 1 wherein the first yarn is a heat set yarn having a standard twist rate in a range of about 4½ to about 5½ twists per inch.

4. The method of claim 1 wherein the first yarn has a twist rate less than a standard twist rate.

5. The method of claim 4 wherein the first yarn has a low twist rate between 0 and 4.5 twists per inch.

6. The method of claim 1 wherein the first yarn has no internal twist.

7. The method of claim 4 wherein the first yarn is a flat yarn pre-twisted to a rate of no more than six twists per inch.

8. The method of claim 1 wherein the first yarn is a flat yarn.

9. The method of claim 8 wherein the first yarn is pre-twisted to a rate of up to three twists per inch.

10. The method of claim 1 wherein at least one of the first and second yarns are solution dyed yarns.

11. The method of claim 10 wherein both the first and the second yarns are solution dyed yarns.

12. The method of claim 1 further comprising a third yarn combined with the first and second yarns through the single needle.

13. The method of claim 12 wherein the third yarn has an internal twist rate less than six twists per inch.

14. The method of claim 13 wherein the third yarn is a heat set yarn having a standard twist rate in a range of about 4½ to about 5½ twists per inch.

15. The method of claim 13 wherein the third yarn has a twist rate less than a standard twist rate.

16. The method of claim 13 wherein the third yarn has a low twist rate between 0 and 4.5 twists per inch.

17. The method of claim 13 wherein the third yarn has no internal twist.

18. The method of claim 17 wherein the third yarn is a flat yarn.

19. The method of claim 13 wherein the third yarn is a flat yarn pre-twisted to a rate of no more than six twists per inch.

20. The method of claim 19 wherein the third yarn is a flat yarn pre-twisted to a rate of up to three twists per inch.

* * * * *